US005695194A

United States Patent [19]

Nagel

[11] Patent Number: 5,695,194

[45] Date of Patent: Dec. 9, 1997

[54] DOMED GAME DEVICE

[76] Inventor: Dietmar Nagel, 11 South Rd., Chester, N.J. 07930-2739

[21] Appl. No.: 787,685

[22] Filed: Jan. 23, 1997

[51] Int. Cl.[6] ..... A63F 7/00

[52] U.S. Cl. ..... 273/357; 273/340

[58] Field of Search ..... 273/340, 355, 273/357, 440, 356

[56] References Cited

U.S. PATENT DOCUMENTS

| | | | |
|---|---|---|---|
| 3,108,808 | 10/1963 | Peterson | 273/357 |
| 4,253,669 | 3/1981 | Ferris et al. | 273/357 |
| 4,371,171 | 2/1983 | Silverman et al. | 273/357 |
| 4,787,640 | 11/1988 | Barlow | 273/357 |
| 4,928,968 | 5/1990 | Gebert | 273/357 |

*Primary Examiner*—Mark S. Graham
*Attorney, Agent, or Firm*—Cohen, Pontani, Lieberman & Pavane

[57] ABSTRACT

A domed game including a transparent dome mounted to a hollow base with game balls enclosed therein. The base has a top surface comprising a shoulder and a concave cavity. A plurality of ball recesses are arranged along the shoulder. A colored lever is associated with each of the ball recesses. Protruding from the top of the dome is a movable activating member. When the activating member is moved to an activated state an engaging member connected to the activating member, slides to an engaged position whereby power is supplied to a motor. The motor is operatively connected to a rotating member in the bottom of the base which rotates and thereby causes the balls in the base to randomly project into the dome. Some of the projected balls will randomly fall or drop into the ball recesses. The user depresses the lever and thereby ejects from the ball recess balls that do not match in color with the associated lever. The first player or user to obtain balls in each of the ball recesses which match the color of the associated levers wins.

18 Claims, 6 Drawing Sheets

DOMED GAME DEVICE

BACKGROUND OF THE INVENTION

1. Field of the Invention

The present invention relates to a game apparatus, and in particular a domed game apparatus which as operable and intended for use is educational and suitable for use by relatively young children.

2. Description of the Related Art

Children learn best when concepts are conveyed in an exciting, challenging, and fun manner. Learning can be most interesting when children are encouraged to actively participate. Recently these findings have influenced the development of educational toys and games for children of various ages. During extended repeated periods of use of educational games or toys, children can master basic concepts such as identifying colors, numbers and letters.

The educational toy or game must be appealing and attractive to a child so that he or she will want to participate and play with the device. This may be accomplished by appealing to the child's senses, as for example by providing a toy or game that is brightly colored, noisy and manipulative. These considerations, however, must be balanced or weighed against the overall cost and complexity of the device and safety concerns.

It is therefore desirable to provide a game or toy which is educational, attractive, appealing, relatively simple and inexpensive and safe for children of all ages.

OBJECTS OF THE INVENTION

An object of the present invention is to provide a domed game device which is educational in that it teaches and reinforces basic concepts such as identification of colors, numbers and letters while simultaneously promoting a desire to learn and developing eye-hand coordination.

Another object of the present invention is to provide a domed game device which is totally self-contained without any loose or removable parts and thus, safe even when used by relatively young children.

A further object of the present invention is to provide a domed game device which is appealing and attractive both visually and audibly.

Another object of the present invention is to provide a domed game device which is relatively simple in design and relatively inexpensive to manufacture.

SUMMARY OF THE INVENTION

The present invention is directed to a domed game device, and in particular to a domed game apparatus for use by relatively young children. In accordance with the present invention, the domed game device includes a transparent dome mounted to a hollow base with game balls enclosed therein. The base has a top surface comprising a shoulder and a concave cavity. A plurality of ball recesses are arranged along the shoulder. A colored lever is associated or corresponds with each of the ball recesses. Protruding from the top of the dome is a push-pull activating member. When the activating member is pulled or displaced to an activated state an engaging member, connected to the activating member by a shaft, slides upward to an engaged position whereby power is supplied to a motor. The motor is operatively connected to a rotating member in the bottom of the base which rotates and causes the balls in the base to project into the dome. Some of the projected balls fall or drop into the ball recesses. The user depresses the lever and ejects from the ball recess balls that do not match in color with the corresponding or associated lever. The first player or user to retain or position balls in each of the ball recesses which match in color with the color of the player's associated or corresponding levers wins.

The invention further relates to a method for matching colored balls with associated or corresponding colored levers by activating a motor, randomly projecting colored balls into a transparent dome and ejecting balls from the ball recesses when the balls therein differ in color from the corresponding or associated levers until all balls and levers of at least one player—the winner—match.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
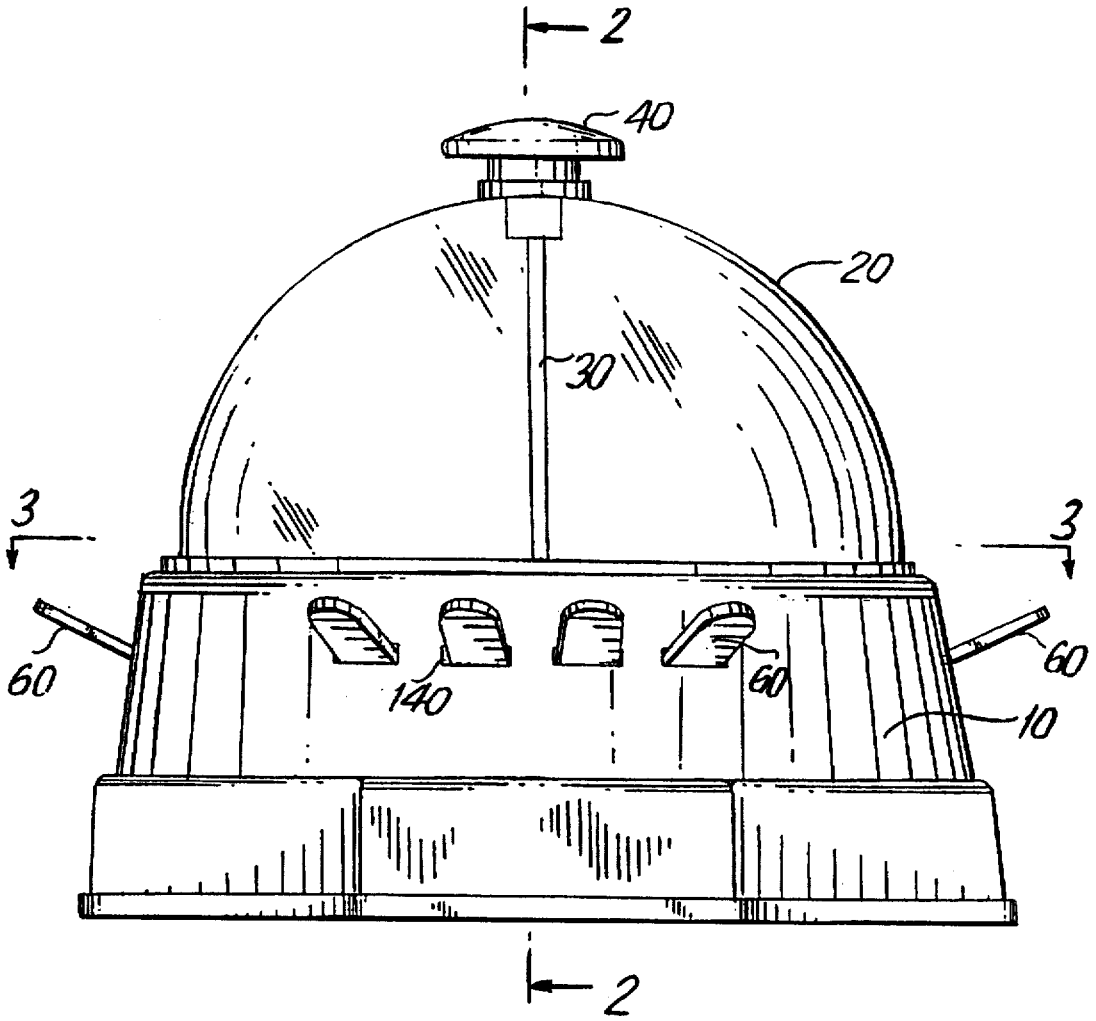
FIG. 1 diagrammatically depicts a side-view of a domed game device constructed in accordance with the present invention.
Figure 2:
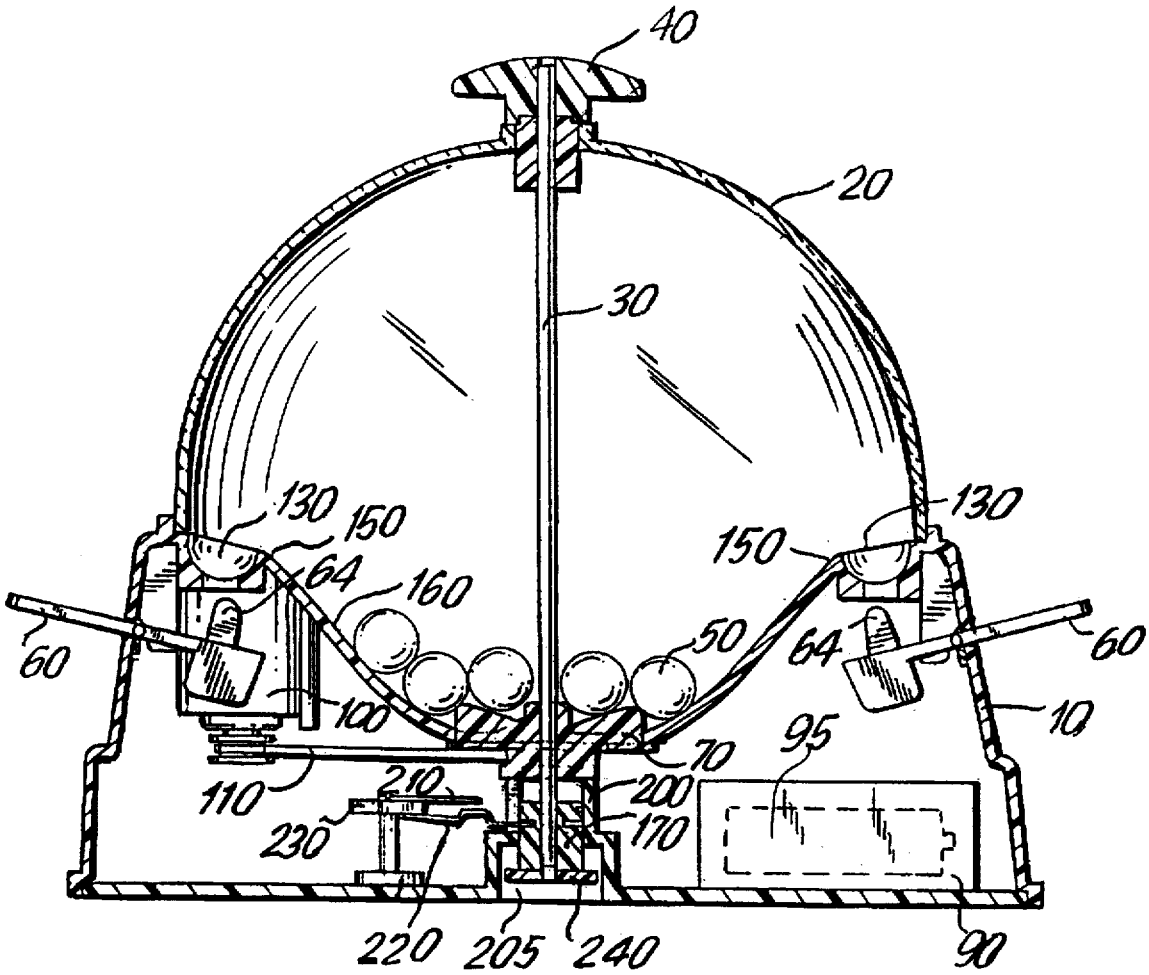
FIG. 2 diagrammatically depicts an axial cross-sectional view of the domed game device of FIG. 1 along the lines 2—2.
Figure 4:
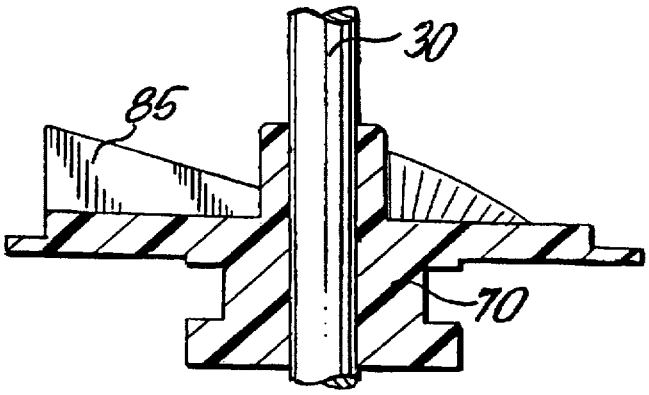
FIG. 4 diagrammatically depicts an enlarged cross-sectional view of the rotating member of the domed game device of FIG. 3 along the lines 4—4.
Figure 3:
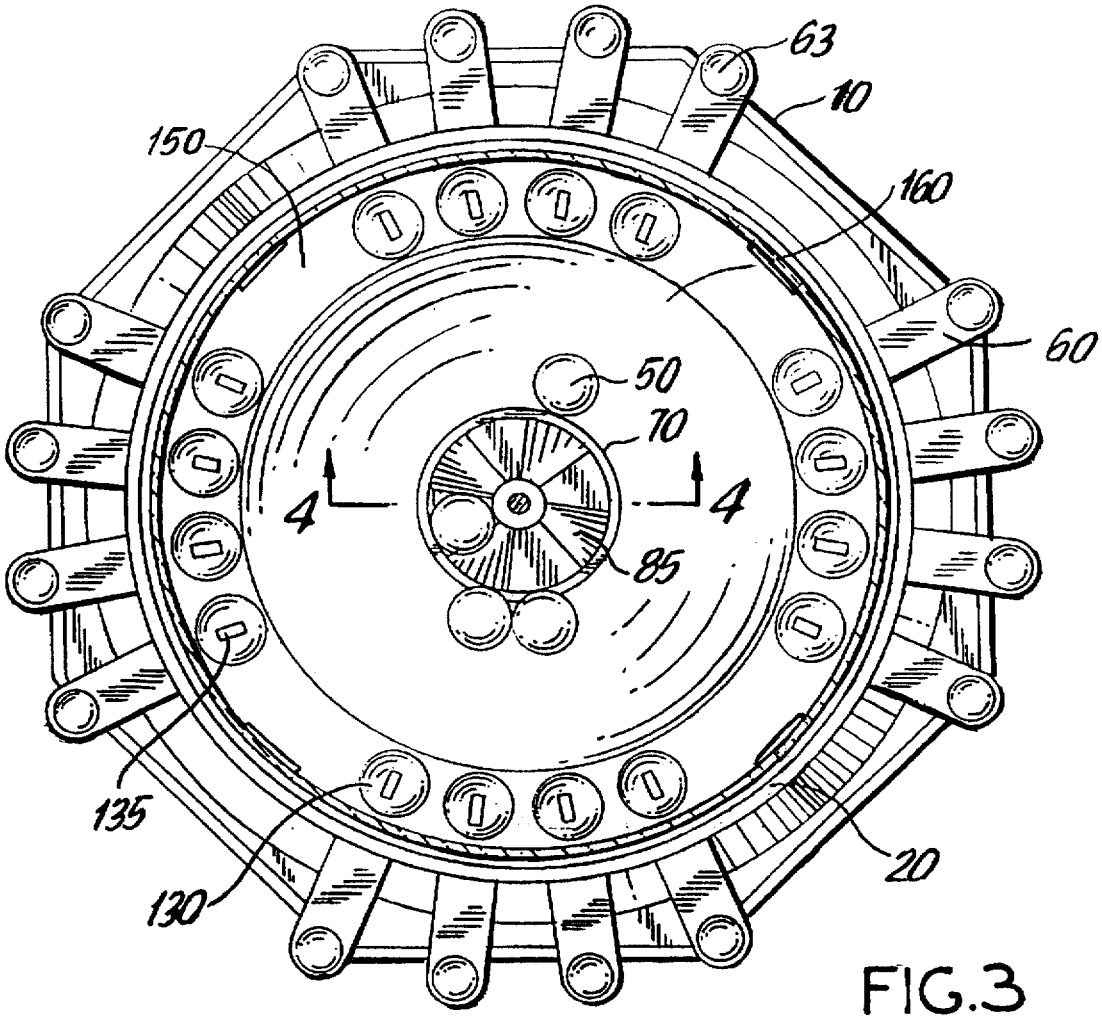
FIG. 3 diagrammatically depicts a top plan view of the domed game device of FIG. 1 along the lines 3—3.
Figure 5:
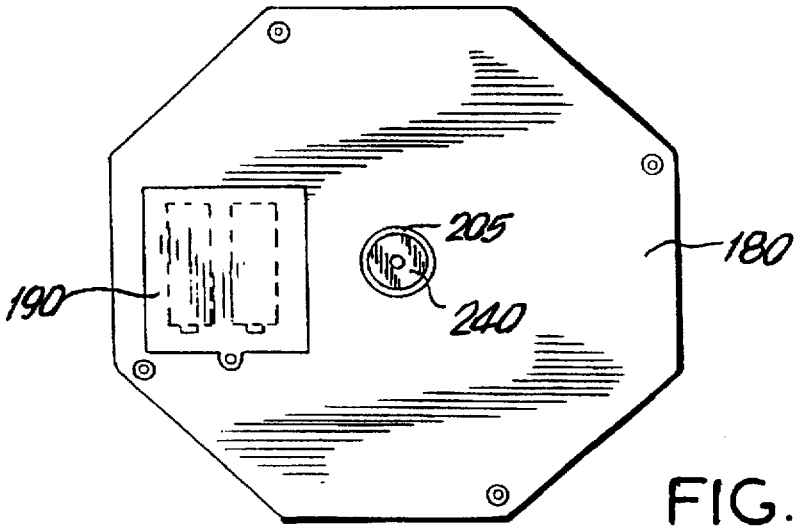
FIG. 5 diagrammatically depicts a bottom plan view of the domed game device of FIG. 1.

FIGS. 1 and 2 show a side view and an axial cross-sectional view of a preferred embodiment of a domed game device constructed in accordance with the present invention. The domed game device includes a hollow base 10 with an open bottom for receiving a bottom plate 180, as shown in FIG. 5, and a top surface. The top surface of base 10 comprises a shoulder 150 extending radially inward from its inner perimeter and a concave shaped recess or cavity 160. At the bottom of concave cavity 160 a circular opening is formed for receiving a rotating member 70. As shown in FIGS. 3 and 4, rotating member 70 has a passageway defined axially therethrough and a top surface divided into a series of generally wedge shaped members in which alternating wedge shaped members comprise substantially horizontal wedge shaped members 80 and upwardly sloping wedge shaped members 85. Although eight such substantially alike members are shown, any number of equal or unequal wedge shaped members may be present.

Base 10 is depicted throughout the figures, for illustration purposes only, as having a generally octagonally shaped open bottom and a substantially circular top surface. It is, however, contemplated and within the intended scope of the invention that the open bottom of base 10 may be of any desired shape, as for example a circle or polygon.

A transparent dome 20 is mounted to the top surface of base 10, enclosing shoulder 150, and culminates at its apex with a hole defined axially therethrough. This hole receives a non-bulbous end of a push-pull activating member 40. The non-bulbous end of activating member 40 has a diameter smaller than a diameter of the hole so that it passes freely therethrough. As a result, activating member 40 is capable of axial displacement in an upward-downward direction when pulled or pushed by a player, operator or user. An opposite bulbous end of activating member 40 protrudes from the top of dome 20, and has a diameter larger than that of the hole so that the activating member is prevented from passing completely or entirely through the hole to an impenetrable position within the dome.

Figure 8A:
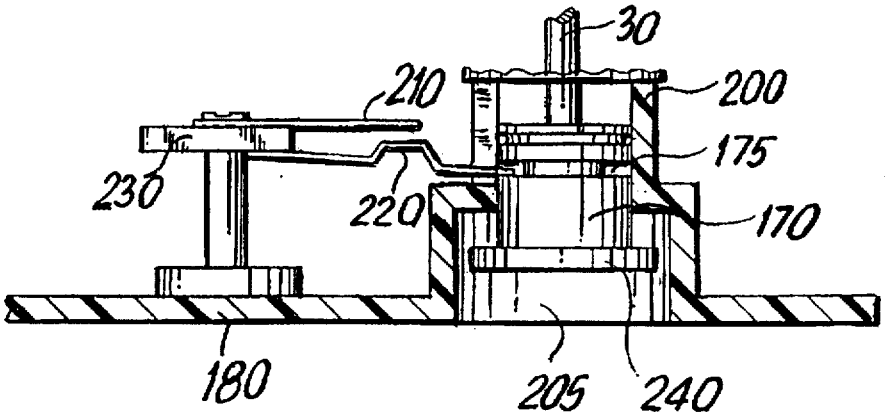
FIG. 8*a* diagrammatically depicts the engaging member of FIG. 2 in a disengaged state with the first and second electrical contacts separated by a space.
Figure 8B:
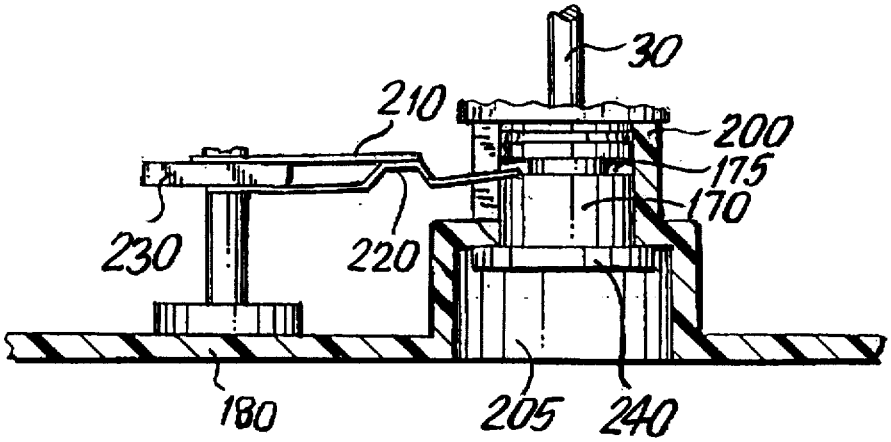
FIG. 8*b* diagrammatically depicts the engaging member of FIG. 2 in an engaged state with the second electrical contact abutting the first electrical contact.
Figure 8C:
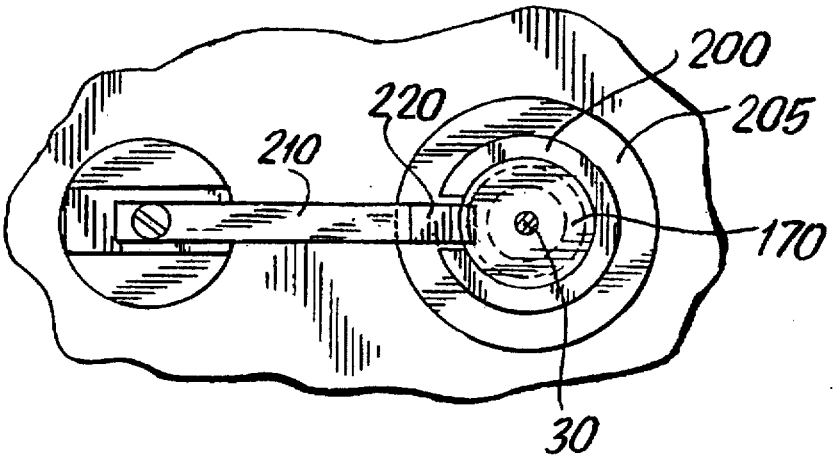
FIG. 8*c* diagrammatically depicts a top plan view of the engaging member of FIG. 8*a*.

In FIG. 2, a shaft 30 is mounted between the non-bulbous end of activating member 40 and a slidable engaging member 170 concentrically positioned within a supporting sleeve 200. Shaft 30 extends axially through the domed game device, and in particular through dome 20, concave cavity 160, rotating member 70 and supporting sleeve 200. Supporting sleeve 200 is mounted to bottom plate 180 and has a longitudinally defined channel 195 that extends the length thereof as shown in FIG. 8*c*. Protruding from bottom plate 180 into base 10 is a concentrically positioned cylindrical recess 205 with an opening defined at the top of the cylindrical recess through the bottom plate. The diameter of the opening in bottom plate 180 is greater then the diameter of engaging member 170 so that the engaging member passes freely therethrough and into cylindrical recess 205. Engaging member 170 is mounted to a stopping member 240 as shown in FIG. 5. Stopping member 240 has a diameter greater than the diameter of the opening in bottom plate 180 to thereby prevent engaging member 170 from passing completely or entirely therethrough. Cylindrical recess 205 provides sufficient clearance for engaging member 170 to move or slide in a vertical direction in response to force applied by the player, operator or user to axially pull up on or push down on activating member 40.

A first electrical contact 210 is mounted within base 10 proximate and substantially perpendicular to engaging member 170. One end of a second electrical contact 220 is mounted beneath first electrical contact 210 with an insulating member 230, as for example wood, interposed therebetween. First electrical contact 210 is substantially planar and substantially parallel to bottom plate 180 whereas second electrical contact 220 is bent. A free end of second electrical contact 220 extends through the longitudinal channel 195 of support sleeve 200 and is wedged, or otherwise affixed in some manner, within a groove 175 around a perimeter of engaging member 170 so that the second contact abuts the first contact when engaging member 170 is in an engaged state or position, and so that the second contact is separated from the first contact by a space when engaging member 170 is in a disengaged state or position. Specifically, as activating member 40 is pulled upwards to the activated position, engaging member 170 slides upwards through supporting sleeve 200 to the engaged state or position and second contact 220 abuts first contact 230 to complete an electrical connection therebetween. As activating member 40 is pushed downwards to the deactivated position, on the other hand, engaging member 170 slides downward through supporting sleeve 200 to the disengaged position which, in turn, causes second contact 220 to separate from or brake the electrical connection with first contact 230. FIGS. 8*a* and 8*b* show electrical contacts 210 and 220 when engaging member 170 is in the disengaged position and engaged position, respectively.

The herein disclosed domed game device is constructed and depicted in the figures, for purposes of illustration only, as suitable for and able to accommodate four or less players but may alternatively be adapted, as a general matter of design choice, for use with or by any number of one or more players and/or player positions. The mechanical parts are the same throughout and may be adjusted accordingly based on the number of players. A top plan view of the domed game device in FIG. 3 shows ball recesses 130 successively arranged about the shoulder 150 in groups of four with one such group in each of the four quadrants of a circle defined by the perimeter of base 10. The grouping and arrangement of ball recesses 130 may be modified as desired to include any number of recesses arranged successively in groups or suitably interweaved.

Figure 7A:
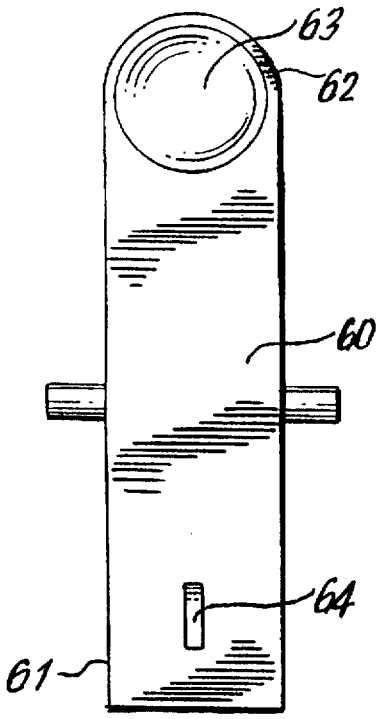
FIG. 7*a* diagrammatically depicts a top plan view of the lever of FIG. 2.

Each ball recess 130 has a corresponding or associated lever 60 with unequally weighted ends, a heavier end 61 and a lighter end 62 as shown in FIG. 7*a*. In a preferred embodiment or arrangement, levers 60 may be of any color(s), as for example red, green, yellow or blue, and the balls 50 correspond in color to the different colored levers with an equal number of balls, for example six, of each color. It is also contemplated and within the scope of the invention to include an unequal number of balls which differ in number or color from that of the levers. A rib 64 protrudes from a top surface of lever 60 and is positioned near its heavier internally-disposed end 61; likewise, a finger indentation 63 along the top surface of lever 60 is located near its externally-located lighter end 62 and aids in discouraging or preventing the user's finger from slipping during operation. Lever 60 is arranged so that its lighter end 62 protrudes through an associated or corresponding slot 140 formed in the side of base 10 and its opposite heavier end 61 is positioned beneath the corresponding or associated ball recess 130.

Figure 6:
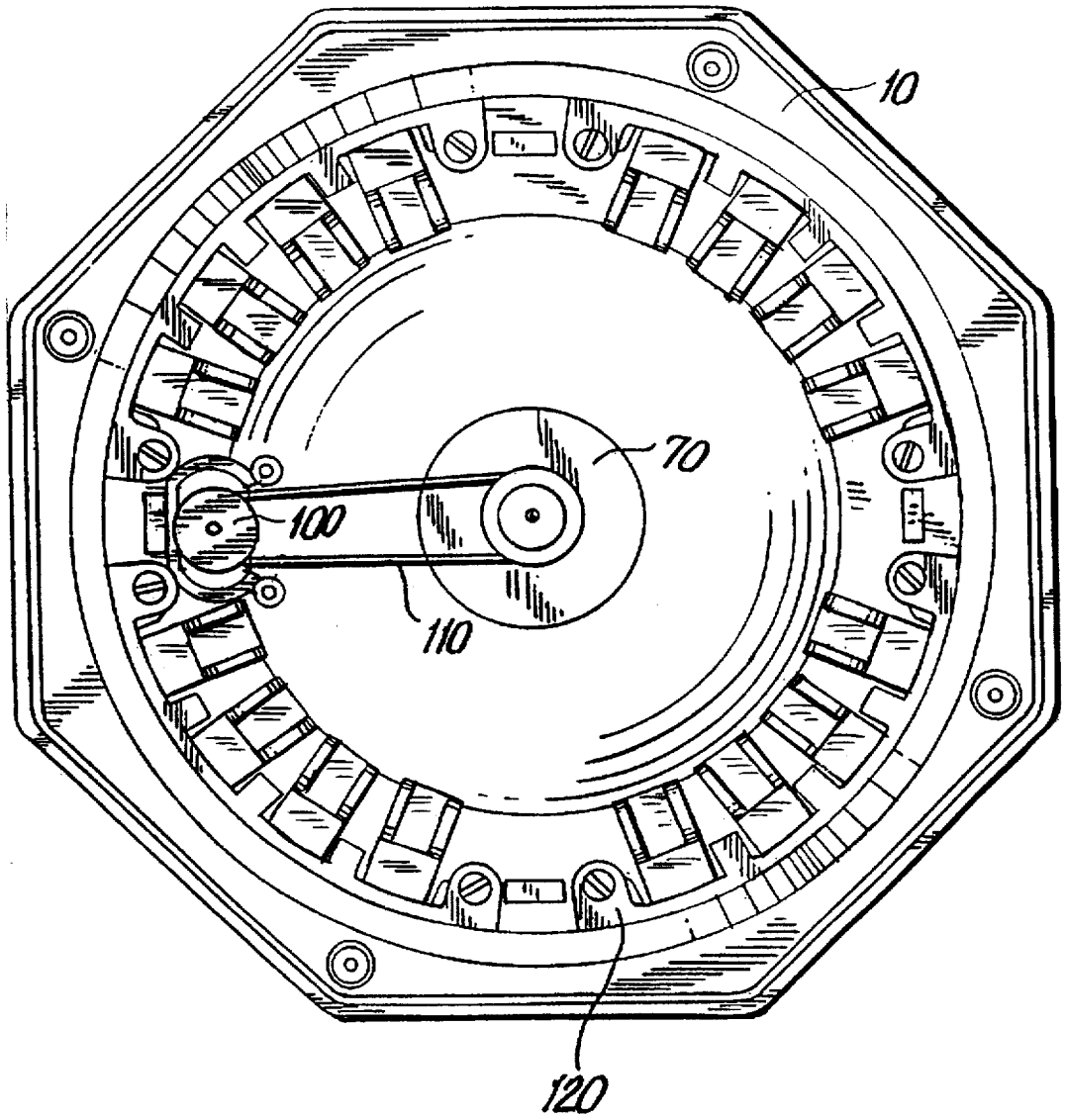
FIG. 6 diagrammatically depicts a bottom plan view of the domed game device of FIG. 1 with the bottom plate removed.
Figure 7B:
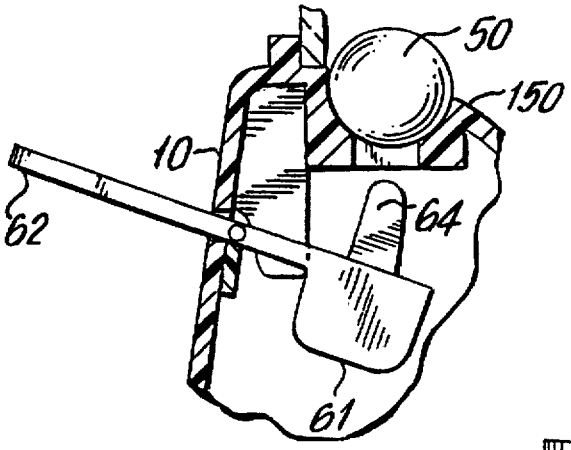
FIG. 7*b* diagrammatically depicts a side cross-sectional view of the lever of FIG. 2 in a first state.
Figure 7C:
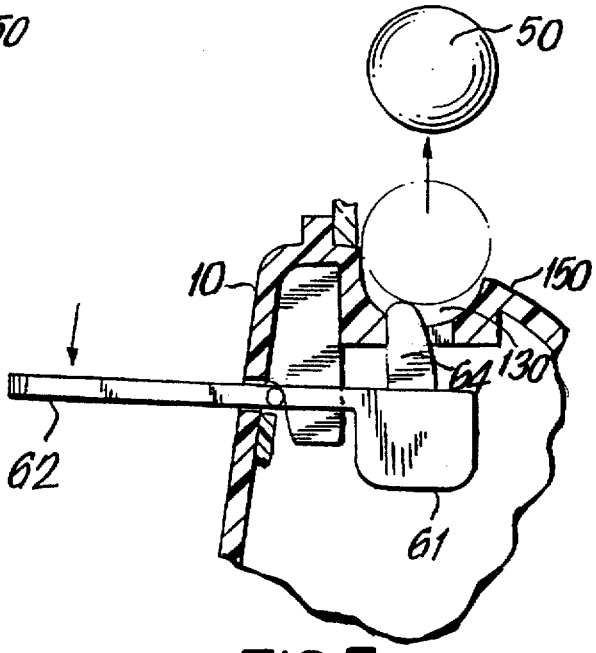
FIG. 7*c* diagrammatically depicts a side cross-sectional view of the lever of FIG. 2 in a second state.

As shown in the cross-sectional view of base 10 in FIG. 6, lever 60 is interposed between a supporting member 120 and concave cavity 160 to thereby form a fulcrum or point about which it pivots between a first and a second state. In the first state, shown in FIG. 7*a*, and free from user or operator-imposed forces, lever 60 is positioned so that its lighter exterior end 62 is elevated relative to its heavier interior end 61. When a user or operator depresses lighter end 62, lever 60 pivots to its second state, shown in FIG. 7*b*, in which the heavier end is elevated or substantially level relative to the lighter end. In this second state rib 64 protrudes through slit 135 of ball recess 130 and causes any ball resting therein to be ejected, expelled, or dislodged. As a result of the unequal weighting of the ends of the lever, when the user or operator thereafter removes his or her finger from lighter end 62, lever 60 automatically pivots back to its first state. Each lever associated with each recess is at least substantially the same and operates independently of any other lever. This mechanism is relatively inexpensive and simple and is thus a preferred means for displacing the balls from the recesses. In an alternative embodiment or arrangement a more expensive and complex spring loaded lever may be employed.

Referring to FIG. 2, a motor 100 within base 10 is electrically connected, through electrical contacts 210, 220 to a power supply 90. Power is preferably supplied using batteries so that the game device is readily portable; however, the use of alternative forms of power are also contemplated and within the scope of the invention. Motor 100 is operatively connected via a pulley or band or belt 110, as for example a rubber band, to drive rotating member 70.

FIG. 5 shows a bottom plan view of the domed game device of FIG. 1. Back plate 180 supports power supply 90 and closes the open end of base 10. In the preferred embodiment in which batteries are used, back plate 180 includes a battery door 190 for closing a battery receptacle or recess.

During operation, activating member 40 is initially disposed in the deactivated or off position or state. An operator or user pulls the bulbous end of activating member 40 upward to the activated position or state so as to supply power to the device and start the game. As a result thereof, engaging member 170, which is connected to activating member 40 via shaft 30, slides upward through the hole in cylindrical recess 205 and supporting sleeve 200 to its engaged position in which stopping member 240 abuts the top of cylindrical recess 205. With engaging member 170 in the engaged position second electrical contact 220, which is wedged within groove 175 of engaging member 170, abuts first electrical contact 210 to form a closed circuit by which power from supply 90 is supplied to electric motor 100 which drives band 110 to cause rotation of rotating member 70. As member 70 rotates balls 50 resting within concave cavity 160 are randomly projected into dome 20. Some of the projected balls drop and fall into ball recesses 130 along shoulder 150 of base 10. Meanwhile, an operator or user observes the balls through the transparent dome 20 as they drop into the ball recesses 130. When a ball different in color from the color of its associated or corresponding lever drops into a ball recess the player, user or operator depresses lighter end 62 of the corresponding or associated lever to cause it to pivot to its second state. As a result, rib 64 protrudes through slit 135 of ball recess 130 to thereby cause the ball to be ejected, expelled or dislodged therefrom. Lever 60 automatically returns to the second state as soon as the player, operator or user withdraws his or her finger from its lighter end 62. This process continues until one player successfully obtains balls in all of the player's ball recesses that match in color to the associated or corresponding levers.

After the game is over, or when finished playing with the device, the user or operator pushes activating member 40 downward to its disengaged position or state. This causes, engaging member 170 to slide downward through supporting sleeve 200 and the hole in cylindrical recess 205 to its disengaged position or state in which the bulbous end of activating member 40 abuts the hole at the apex of dome 20. When engaging member 178 slides from the engaged to the disengaged position or state second electrical contact 220, which is wedged within groove 175 of engaging member 170, separates from first electrical contact 210 to define a space therebetween. Power is thereby cut off from motor 100 which causes rotating member 70 to stop rotating and the balls 50 to come to rest in concave cavity 160.

The domed game device may also be constructed using different colored balls and levers. The device may be adapted or modified to teach other concepts in addition to, or in lieu of, identification of colors. For instance, the balls may be labeled with numbers or letters and the levers labeled with associated or corresponding numbers or letters. The domed game device as herein disclosed is advantageously portable, lightweight and, in addition to batteries, requires only a substantially flat surface upon which to rest, for example a floor, table or even one's lap.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A game apparatus for use with a plurality of balls of at least two different attributes, said apparatus comprising:

a base having a peripheral shoulder in which a plurality of recesses, each sized for receiving and retaining a ball, are defined about the periphery of the base, and said base defining a concave cavity surrounded by said shoulder;

a dome, at least a portion of which is substantially transparent, forming with said cavity a closed game space about and including said shoulder and concave cavity;

a driven member disposed for operative rotation within said concave cavity and configured so that, as said member rotates, it causes balls in said concave cavity to be randomly projected outwardly from said concave concavity within said closed game space such that random ones of the projected balls are projected onto said shoulder and are randomly received and retained in random ones of said shoulder recesses;

powered means selectively operable by a user of said apparatus for causing rotation of said driven member; and a plurality of user operable displacement members each selectively movable by a user from a first position to a second position to effect selective displacement from a corresponding one of said shoulder recesses of a ball present in said corresponding shoulder recess;

each of at least one of said plural recesses and said plural corresponding displacement members having one of the at least two different attributes of the plural balls so that when one of the balls is randomly received and retained in a random one of said shoulder recesses the received and retained ball may have the same attribute as the at least one of the recesses in which the ball is present and the corresponding displacement member, or the received and retained ball may have an attribute different from the at least one of the recesses in which the ball is present and the corresponding displacement member, and a decision by a user of said apparatus as to whether to selectively move a particular one of said displacement members being based on whether the received and retained ball present in an associated shoulder recess has the same or the different attribute as the attribute of the at least one of the recesses in which the ball is present and the corresponding displacement member.

2. The game apparatus of claim 1, wherein said powered means further comprises an activating member axially disposed within said closed game space and movable between an activated state in which operating power is supplied to said driven member to cause the driven member to rotate and a deactivated state in which operating power is cut off from said driven member.

3. The game apparatus of claim 2, wherein said powered means further comprises an engaging member disposed in said base and movable between an engaged position and a disengaged position, said engaging member being connected to said activating member by an elongated shaft extending axially through said dome, said driven member and said base.

4. The game apparatus of claim 3, wherein said powered means further comprises first and second electrical contacts, said first contact being operatively disposed and movable relative to said second contact and to said engaging member such that said electrical contacts are disposed in electrical contact to complete an electrical connection between them for supplying operating power to said driven member to cause it to rotate when said engaging member is in the engaged position, and are separated from one another to cut off power to said driven member so that the driven member does not operatively rotate when said engaging member is in the disengaged position.

5. The game apparatus of claim 4, wherein the first electrical contact is connected to said engaging member within a groove defined about its perimeter.

6. The game apparatus of claim 4, wherein said second electrical contact is bent relative to and displaced from the first electrical contact.

7. The game apparatus of claim 1, wherein each of said plural displacement members extends outwardly from the base through a corresponding slot defined in the periphery of said base.

8. The game apparatus of claim 7, wherein said displacement members are interposed between a supporting member and the concave cavity to thereby define a point about which said displacement members pivot between the first and second positions.

9. The game apparatus of claim 8, wherein each of said plural displacement members is unequally weighted and is disposed with a relatively heavier first end within said base below the corresponding shoulder recess and a relatively lighter second end protruding outwardly from said base.

10. The game apparatus of claim 9, wherein in the first position, free from user-imposed forces, said each displacement member is disposed with said second end elevated relative to said first end and, in response to user-imposed forces, said each displacement member is pivoted to the second position with said first end elevated relative to said lighter end.

11. The game apparatus of claim 10, wherein each of said displacement members further comprises a top surface and a rib positioned proximate said first end and protruding from the top surface so that in the first position said displacement member and its rib are displaced from the corresponding shoulder recess by a space and in the second position the rib of said displacement member protrudes through an opening in the corresponding shoulder recess to displace a ball present in the corresponding shoulder recess.

12. The game apparatus of claim 10, wherein each said displacement member is configured so that, when the displacement member is disposed in said second position by application of a selected user-imposed force to said second end, said displacement member automatically pivotally returns to the first position when the user-imposed applied force is withdrawn from said second end.

13. The game apparatus of claim 1, wherein said driven member comprises a top surface defining a plurality of substantially wedge shaped extensions.

14. The game apparatus of claim 13, wherein said plural wedge shaped extensions comprise alternating substantially horizontal wedge shaped members and upwardly sloping wedge shaped members.

15. The method of claim 1, wherein said attributes are colors.

16. A method for matching an attribute of each of a plurality of balls having at least two different attributes to a corresponding attribute to one of a plurality of displacement members each having one of the two different attributes associated with said each displacement member in a game device, said game device including a hollow base having a concave cavity and a peripheral shoulder in which a plurality of recesses, each recess sized for receiving and retaining a ball, are defined about the periphery of the base, and a dome, at least a portion of which is substantially transparent, forming with the base a closed game space about and including the shoulder and concave cavity, said method comprising the steps of:

powering a driven member disposed for operative rotation within the concave cavity and configured so that, as said member rotates, it causes balls in the concave cavity to be randomly projected outwardly from the concave cavity within the closed game space such that random ones of the projected balls are projected onto the shoulder and are randomly received and retained in random ones of said shoulder recesses; and selectively displacing selected ones of the balls from selected ones of the shoulder recesses in which balls present in the recesses have a different attribute then the attribute of corresponding displacement members associated with the selected recesses by applying a user imparted force to the corresponding displacement member of a ball containing recess to thereby displace the ball from the recess.

17. The method of claim 16, wherein said step of powering said driving member further comprises:

selectively axially displacing an elongated activating member that extends from an end external of said game device, for access by a user, into the closed game space so as to displace the activating member from a first position in which the driven member is unpowered to a second position in which an electrical current is supplied for operatively rotating the driven member and causing balls in the concave cavity to be randomly projected outwardly from the concave concavity within the closed game space and onto the shoulder for random receipt and retention in random ones of the shoulder recesses, by user-effected movement of the elongated activating member through contact with the external end for selectively displacing the activating member.

18. The method of claim 17, wherein each said displacement member has a first end disposed within the game device proximate a corresponding one of the shoulder recesses and a second end disposed externally of the game device for access by a user, said step of selectively displacing selected ones of the balls from selected ones of the shoulder recesses further comprising applying a user-induced force to the second end of selected ones of the displacement members to pivot the selected displacement members such that the first end of each said pivoted displacement member is displaced toward a corresponding shoulder recess and into contact with a ball contained in the corresponding shoulder recess to displace the contained ball from within the corresponding shoulder recess.

* * * * *